US006074047A

United States Patent [19]

Hotomi et al.

[11] Patent Number: 6,074,047

[45] Date of Patent: Jun. 13, 2000

[54] INK-JET RECORDING HEAD

[75] Inventors: Hideo Hotomi, Nishinomiya; Kusunoki Higashino, Osaka; Hisashi Takata, Takatsuki, all of Japan

[73] Assignee: Minolta Co., Ltd., Osaka, Japan

[21] Appl. No.: 08/859,324

[22] Filed: May 20, 1997

[30] Foreign Application Priority Data

May 21, 1996 [JP] Japan ..... 8-125496
May 31, 1996 [JP] Japan ..... 8-138187

[51] Int. Cl.[7] ..... B41J 2/045

[52] U.S. Cl. ..... 347/70; 347/94

[58] Field of Search ..... 347/71, 10, 70, 347/68, 94

[56] References Cited

U.S. PATENT DOCUMENTS 4,268,134 5/1981 Gulati et al. ..... 351/163
5,184,155 2/1993 Yonekubo et al. ..... 347/68
5,208,605 5/1993 Drake .
5,412,410 5/1995 Rezanka .
5,446,485 8/1995 Usui et al. .
5,539,982 7/1996 Hosono et al. ..... 347/70

OTHER PUBLICATIONS

Asahi Chemical Industry News, Asahi Chemical Synthesizes PPTA Aramide Amorphous Films, Aug. 1991.

*Primary Examiner*—John Barlow
*Assistant Examiner*—An H. Do
*Attorney, Agent, or Firm*—McDermott, Will & Emery

[57] ABSTRACT

In an ink-jet recording head using piezoelectric members, unwanted ejection of an ink material due to cross-talk is prevented. A head 10 comprises a channel plate 16 provided with a plurality of nozzles 28 and ink cavities 26, respectively, a diaphragm 18 adapted to cover the ink cavities, a vibration plate 20 with a plurality of piezoelectric members opposed to respective ink cavities through the diaphragm and a base plate 22 for supporting the piezoelectric members. The base plate 22 is formed such that a value of the elastic modulus multiplied by the thickness thereof is about $9.0\times10^3$ (kgf/mm) or more.

6 Claims, 5 Drawing Sheets

*Fig.4*

| | Material of base plate | Elastic modulus of base plate ($kgf/mm^2$) | Thickness of base plate (mm) | Elastic modulus × Thickness (kgf/mm) | Ratio of deformation (%) | Evaluation |
|---|---|---|---|---|---|---|
| test sample 1 | Stainless steel (SUS#304) | 17,000 | 0.5 | 8,500 | 40 | Poor |
| test sample 2 | Ceramic ($SiO_2$) | 5,000 | 1.9 | 9,500 | 6.5 | Fair |
| test sample 3 | Vectran with Tio filler (total aromatic liquid crystal prepared by Celanese) | 670 | 15 | 10,050 | 3.2 | Good |
| test sample 4 | Stainless steel (SUS#304) | 17,000 | 0.8 | 13,600 | 5.0 | Good |
| test sample 5 | Ceramic ($SiO_2$) | 5,000 | 4 | 20,000 | 2.3 | Good |
| test sample 6 | Ceramic ($Al_2O_3$) | 6,200 | 3.5 | 21,700 | 1 | Very Good |
| test sample 7 | Ceramic (ZrO) | 7,800 | 4 | 31,200 | 0.6 | Very Good |

Fig.5

| | Material of adhesive | Elastic modulus of adhesive ($kgf/mm^2$) | Thickness of adhesive (mm) | Elastic modulus / Thickness ($kgf/mm^3$) | Ratio of deformation (%) | Evaluation |
|---|---|---|---|---|---|---|
| test sample 8 | Acryl urethane N.O.810 (Kyoritsu Chemical Industry) | 105 | 0.015 | 7,000 | 46 | Poor |
| test sample 9 | Epoxy E−30H (Konishi) | 200 | 0.025 | 8,000 | 5.5 | Fair |
| test sample 10 | Epoxy E−30H (Konishi) | 200 | 0.02 | 10,000 | 5.0 | Good |
| test sample 11 | Epoxy 862−7 (Able Stick) | 260 | 0.015 | 17,333 | 4.1 | Good |
| test sample 12 | Acrylic 1546 (Three Bonds) | 220 | 0.010 | 22,000 | 3.8 | Very Good |
| test sample 13 | Epoxy AZ−15 (Ciba−Geigy) | 320 | 0.005 | 64,000 | 2.2 | Very Good |
| test sample 14 | Epoxy E−50L (Konishi) | 460 | 0.02 | 23,000 | 3.4 | Very Good |

INK-JET RECORDING HEAD

FIELD OF THE INVENTION

The invention relates to an ink-jet recording head for ejecting an ink material according to vibration of piezoelectric members.

BACKGROUND OF THE INVENTION

Conventionally, there has been proposed an ink-jet recording head which includes ink cavities having an ink material, nozzles fluidly communicating the ink cavities to the air, and piezoelectric members opposed corresponding cavities, for vibrating or deforming the piezoelectric members to pressurize the ink material in corresponding ink cavities and then eject ink droplets into the air.

Typically, in this type of ink-jet recording head, the piezoelectric member is bonded on a rigid substrate or plate. Therefore, part of the vibration caused by one piezoelectric member can be transmitted to adjacent piezoelectric members depending upon the characteristics of the substrate, such as elasticity and thickness in particular, which may result in an unwanted ink ejection to eventually degrade the resultant image. This is referred to as cross-talk.

SUMMARY OF THE INVENTION

A primary object of hte invention may be noted the provision of an ink-jet recording head free from cross-talk.

To this end, the ink-jet recording head of the invention comrises a base plate upon which a plurality of piezoelectric members are mounted side by side. The base plate has a characteristic value of $9.0\times10^3$ (kgf/mm) or more, which characteristic value is obtained by multiplying an elastic modulus thereof by a thichness thereof.

Accordnig to the invention, the base plate so constructed has an sufficient rigidity and therefore reduces the vibration to be transmitted from one piezoelectric member to neighboring ones, preventing the cross-talk to a large extent. This also ensures that no unwanted ink droplet is ejected from the ink cavity, causing a high resolution image.

Preferably, the characteristic value is $1.0\times10^4$ (kgf/mm) or more so that the cross-talk can be reduced. This is also advantageous in durability of the ink-jet recording head.

The thickness of the base plate is allowed to be widely changed unless no adverse affect is provided for the ink-jet recording head, which provides no upper limitation on the characteristic value.

BRIEF DESCRIPTION OF THE DRAWINGS

The present invention will be further described with reference to the accompanying drawings wherein like reference numerals refer to like parts in the several views, and wherein:

FIG. 4 is a table showing the ratios of deformation of a piezoelectric member and evaluation of image qualities when the elastic modulus and thickness of a base plate are varied; and FIG. 5 is a table showing the ratios of deformation of a piezoelectric member and evaluation of image qualities when the elastic modulus and thickness of an adhesive layer formed between the piezoelectric member and base plate are varied.

DESCRIPTION OF A PREFERRED EMBODIMENT

Figure 1:
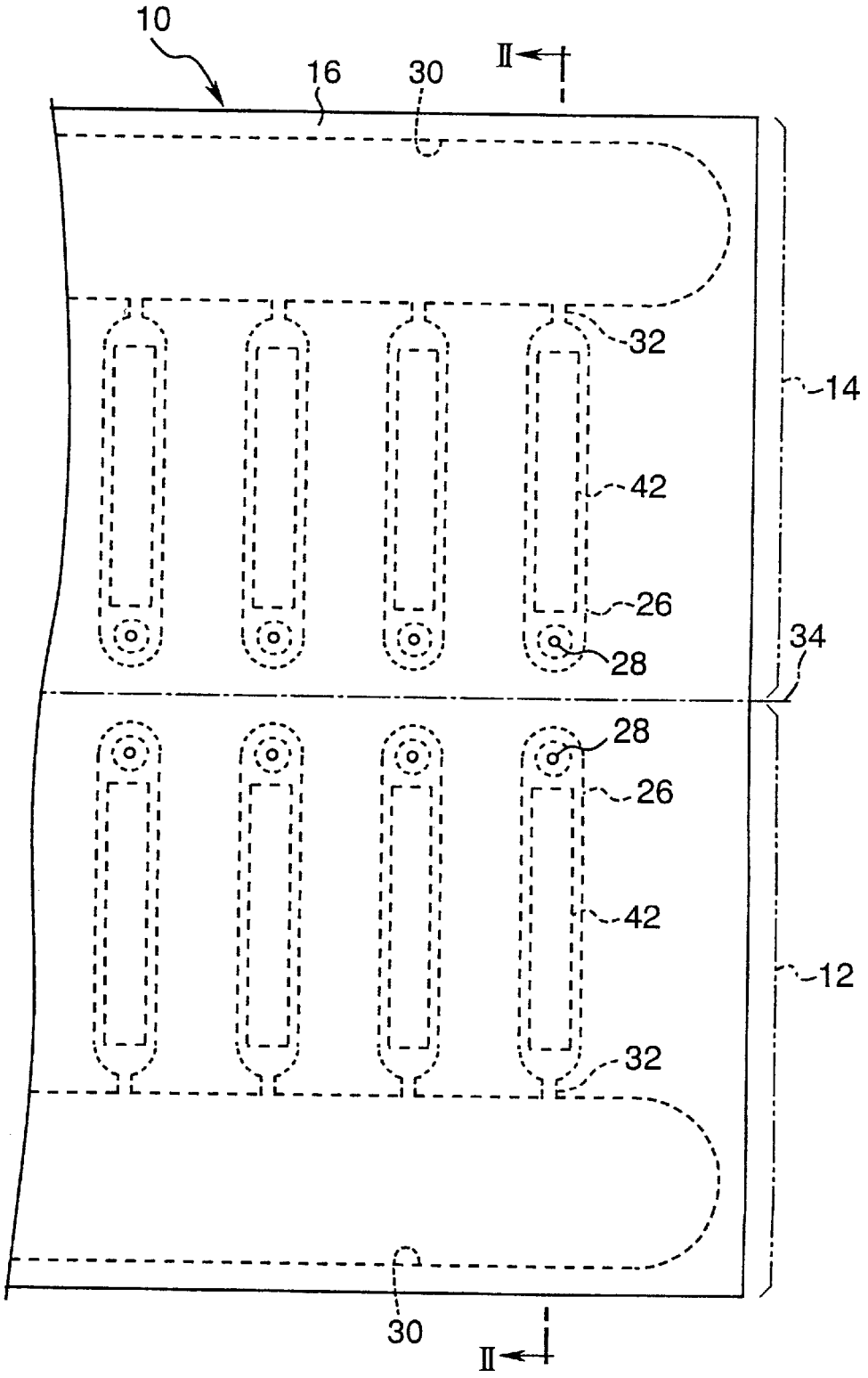
FIG. 1 is an enlarged partial plan view of an ink-jet recording head according to the invention.
Figures 2A, 2B, 2C:
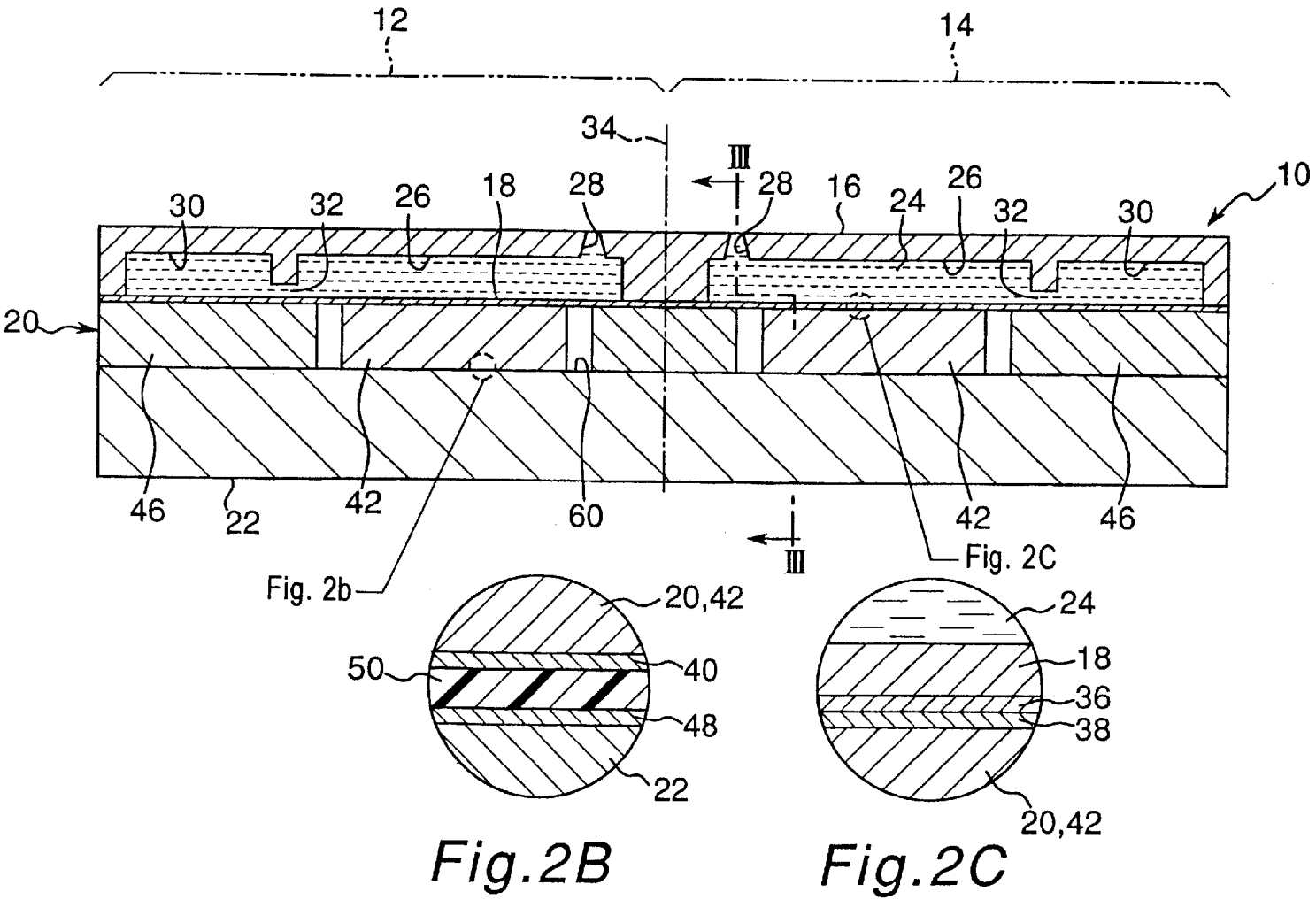
FIGS. 2A to 2C are an enlarged cross-sectional elevational views taken along the line II—II in FIG. 1.
Figure 3:
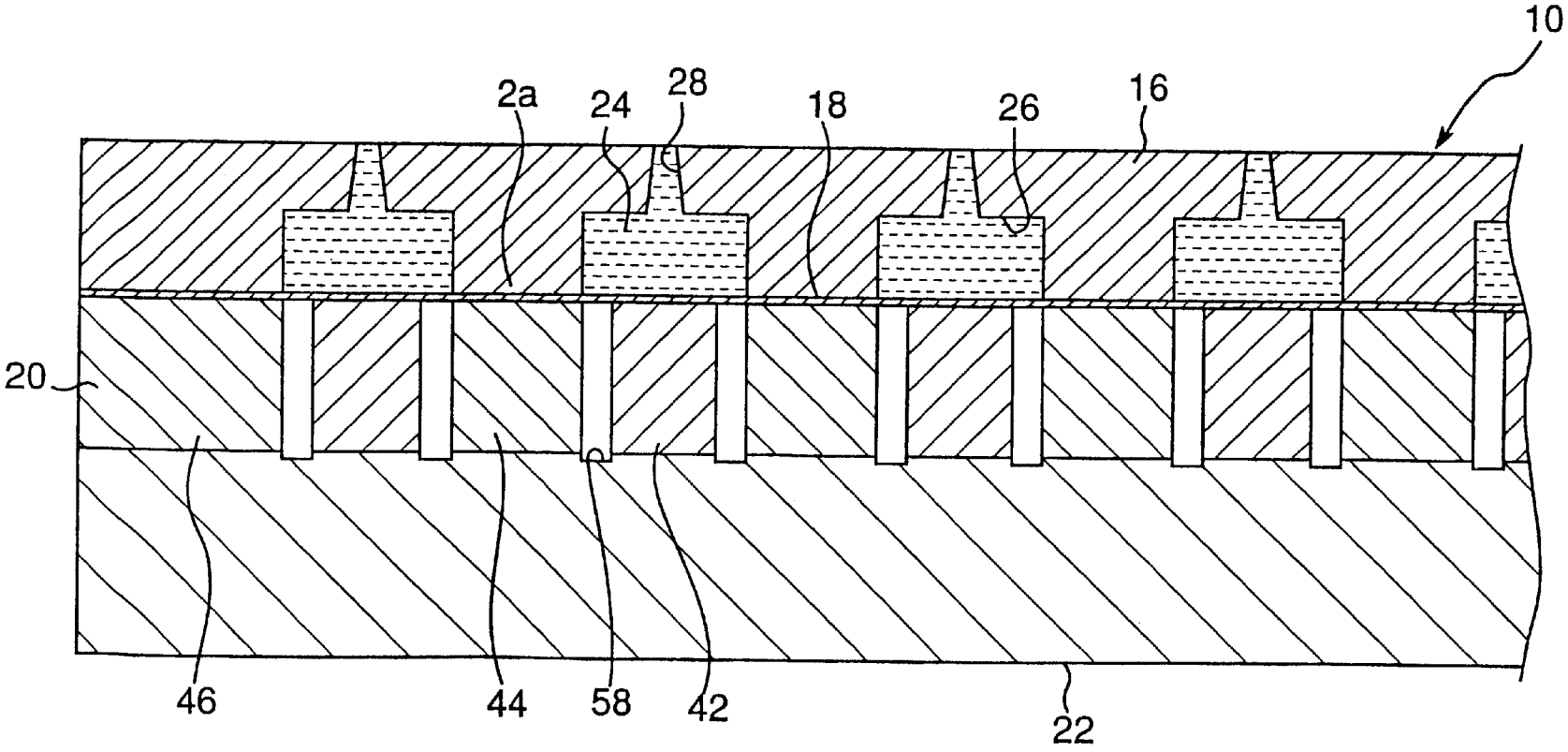
FIG. 3 is an enlarged cross-sectional elevational view taken along the line III—III in FIG. 2.

Referring now to the accompanying drawings, a preferred embodiment of the invention will be described. FIGS. 1 to 3 show a multi-head for use in an ink-jet recording apparatus according to the invention. The multi-head generally indicated by reference numeral 10 comprises a large-diameter ink droplet ejecting head portion 12 (hereinafter "large-diameter head portion") and a small-diameter ink droplet ejecting head portion 14 (hereinafter "small-diameter head portion"), which are formed integrally by a lamination of a channel plate 16, a diaphragm 18, a vibration plate 20 and a base plate 22.

The channel plate 16 is made of a metal, a synthetic resin or the like, and is finely processed in one surface opposite to the diaphragm 18 by electroforming or photolithography to form a plurality of ink cavities 26 that contain an ink material 24, nozzles 28 for ejecting the ink material 24 in the ink cavities 26, ink supply chambers 30 containing the ink material 24 for supply and ink inlets 32 for connecting the ink cavities 26 with the ink supply chamber 30 in the large-diameter head portion 12 and small-diameter head portion 14, respectively. A diameter of the nozzle 28 in the large-diameter head portion 12 is larger than that of the nozzles 28 in the small-diameter head portion 14. As shown in FIG. 1, the ink cavities 26 in the large-diameter head portion 12 and small-diameter head portion 14 are formed into grooves extending in a direction opposed to each head portions 12 and 14 and parallel to each other. The ink supply chamber 30 are formed in the opposite side to a centerline 34 with respect to the ink cavities 26, and connected to an ink tank not shown.

The diaphragm 18 is formed by a thin film of conductive material, and is fixed between the channel plate 16 and vibration plate 20. Preferably, the diaphragm 18 is fixed at a predetermined tension.

The vibration plate 20, made of a piezoelectric material known in the art, is provided on upper and lower surfaces thereof with conductive metal layers 38, 40 for use as common electrodes and individual electrodes, respectively, and fixed between the diaphragm 18 and base plate 22. The vibration plate 20 is first fixed to the base plate 22 by using a conductive adhesive 50 (see FIG. 2B), and then divided by formation of longitudinal grooves 58 and transverse grooves 60 by a dicing process (not shown), and separated into piezoelectric members 42 corresponding to each ink cavity 26, partition walls 44 located between adjacent piezoelectric members 42 and walls 46 surrounding them. As a result of the dicing process, the conductive metal layers on the upper and lower surfaces of the piezoelectric members 42 are also divided by the longitudinal grooves 58 and transverse grooves 60, respectively (see FIG. 2B and 2C), and the metal layer facing the diaphragm 18 provides a common electrode 38, while the metal layer facing the base plate 22 provides a individual electrode 40.

The base plate 22 which is made of a ceramic, a metal, a synthetic resin or the like has a characteristic that a product of the elastic modulus and thickness thereof is at $9.0\times10^3$ (kgf/mm$^2$) or more. In a surface of the base plate 22 opposed to the vibration plate 20, conductive leads 48 (see FIG. 2B) are formed in correspondence with the piezoelectric members 42 of the head portions 12 and 14 by such known method as sputtering and deposition, and the individual electrodes 40 formed as described above are electrically coupled to the conductive leads 48 corresponding thereto through the conductive adhesive 50. In an area where the common electrodes 38 and individual electrodes 40 are opposed to each other, the piezoelectric members 42 are activated, respectively, by a polarization at a high temperature.

In the multi-head 10 so constructed as described above, the ink material 24 is supplied to the ink supply chambers 30 from an ink tank not shown. The ink material 24 in the ink supply chamber 30 is distributed to each ink cavity 26 through the associated ink inlets 32. When a predetermined voltage (print signal) is applied between the common electrode 38 and individual electrode 40 from a print signal control circuit (not shown), the piezoelectric member 42 is deformed. The deformation of the piezoelectric member 42 is transmitted to the diaphragm 18, thus the ink material 24 in the ink cavity 26 is pressurized, and an ink droplet is ejected through the ink nozzle 28. In this embodiment, because the nozzle 28 in the large-diameter head portion 12 has a diameter larger than that of the nozzle 28 in the small-diameter head portion 14, a large-diameter ink droplet is ejected from the large-diameter head portion 12 while a small-diameter ink droplet is ejected from the small-diameter head portion 14. Instead of the single-layered piezoelectric members, multi-layered piezoelectric members with common and individual electrodes alternately positioned between a plurality of piezoelectric elements may be also employed.

By varying the elastic modulus and thickness of the base plate, deformation of the base plate and conditions of ejection of the ink material were studied. Types of the base plate used for measurement, the elastic modulus and thickness of each base plate, product of the elastic modulus and thickness, the ratio of deformation and evaluation of image qualities are shown in a table of FIG. 4. The ratio of deformation is a value (d2/d1) that an amount (d2) of deformation of a particular piezoelectric member when the particular piezoelectric member is maintained in an inoperative state while all other piezoelectric members are operated is divided by an amount (d1) of deformation of the particular piezoelectric member when the particular piezoelectric member is operated while all other piezoelectric members are inoperative. The multi-head shown in FIGS. 1 to 3 was used for the measurement. As the piezoelectric member, however, a multi-layered piezoelectric member with 15 layers of piezoelectric elements each having a thickness of 30 $\mu$m was employed. The piezoelectric member was adhered to the base plate by using an epoxy resin adhesive having the elastic modulus of 260 kgf/mm$^2$, commercially available under the name AZ-15 from Ciba-Geigy Ltd. The adhesive layer was 3 $\mu$m thick. Applied to both electrodes on the piezoelectric member was a pulsating voltage of 50 V with a pulse width of 50 $\mu$sec.

The evaluation was made according to the following criteria.

Evaluation Criteria

- Very good: Almost no cross-talk is caused, and a good quality of image can be obtained.
- Good: Although cross-talk is slightly caused, no ink droplet is ejected, and a good quality of image can be obtained.
- Fair: Although a few ink droplets are ejected due to cross-talk, a fair quality of image can be obtained.
- Poor: The ink droplets are ejected due to cross-talk, causing a poor quality of image.

From a result shown in the table of FIG. 4, below findings were obtained. Almost no cross-talk is caused, when a value of the elastic modulus of the base plate multiplied by the thickness thereof (product of the elastic modulus and thickness) is at about $2.1\times10^4$ (kgf/mm) or more. No ink droplet is ejected, although cross-talk is slightly caused, when the value is at about $1.0\times10^4$ to $2.0\times10^4$ (kgf/mm), thus the quality of image is unaffected in these conditions. Also, the ratio of deformation can be limited to about 5% or less, which is advantageous to increase a service life of a head. When the product of the elastic modulus and thickness is at about $9.5\times10^3$ (kgf/mm), although a few ink droplets are ejected due to cross-talk, no problem is practically caused. However, when the product of the elastic modulus and thickness is at about $8.5\times10^3$ (kgf/mm), the quality of image is affected by the ink droplets ejected due to cross-talk.

Thus, as a lower limit of rigidity required for preventing effects of the cross-talk was determined, by appropriately selecting a material and a thickness of the base plate, reduction in weight of a head can be achieved, while the good quality of image is maintained.

Then, by varying the elastic modulus and thickness of an adhesive layer formed between the piezoelectric member and base plate, deformation of the piezoelectric member and conditions of ejection of the ink material were studied. Types of the adhesive used for measurement, the elastic modulus and thickness thereof, the elastic modulus/thickness, the ratio of deformation and evaluation of image qualities are shown in a table of FIG. 5. In the table, the ratio of deformation is like the above-described value (d2/d1). The apparatus shown in FIGS. 1 to 3 was used for the measurement. As the piezoelectric member, however, a multi-layered piezoelectric member with 15 layers of piezoelectric elements each having a thickness of 30 $\mu$m was employed. A $Al_2O_3$ ceramic plate of 3.5 mm in thickness was used as the base plate. A pulsating voltage applied to both electrodes on the piezoelectric member was at 50 V and a pulse width of 50 $\mu$sec. The evaluation was made according to the above-described criteria.

From a result shown in the table of FIG. 5, below findings were obtained. Almost no cross-talk is caused, when a value of the elastic modulus of the adhesive divided by the thickness thereof (elastic modulus/thickness) is at about $2.0\times10^4$ (kgf/mm$^3$) or more. No ink droplet is ejected, although cross-talk is slightly caused, when the value is at about $1.0\times10^4$ to $2.0\times10^4$ (kgf/mm$^3$), thus the quality of image is unaffected in these conditions. Also, the ratio of deformation can be limited to about 5% or less, which is advantageous to increase a service life of a head. When the elastic modulus/thickness is at about $8\times10^3$ (kgf/mm$^3$), although a few ink droplets are ejected due to cross-talk, no problem is practically caused. However, when the elastic modulus/thickness is at about $7\times10^3$ (kgf/mm$^3$), the quality of image is affected by the ink droplets ejected due to cross-talk.

Although the embodiment has been described by taking a multi-head as an example of ink-jet recording head, the invention is, of course, applicable to an ink-jet recording head of a single-head type that ejects ink droplets of a uniform size.

Additionally, although the common electrodes 38 and individual electrodes 40 have been provided on the upper and lower surfaces of the piezoelectric member 42, respectively, the conductive diaphragm 18 may be also used as common electrodes, and the conductive adhesive 50 may be also employed as individual electrodes. Such arrangement is advantageous in that production of the vibration plate 20 is facilitated by eliminating a process for forming the electrodes.

The grooves 58 and 60 around the piezoelectric members 42 may be filled with a soft filler that doesn't forcibly restrict deformation of the piezoelectric members 42.

Although the piezoelectric member 42 has not been in contact with the ink material 24, the invention is also applicable to an ink-jet head of such type that a piezoelectric member is in contact with an ink material. However, in such case, it is desirable that a coating layer is provided on a surface of the piezoelectric member that is in contact with the ink material so that penetration of the ink material is prevented.

Further, although the diameter of nozzles 28 has been different between the large-diameter head portion 12 and small-diameter head portion 14 so that ink droplets of different diameters are ejected from respective head portions, different sizes of ink droplets may be obtained by varying the voltage of signals applied to respective head portions.

When the ink cavities 26 and piezoelectric members 42 are of different lengths between the large-diameter head portion 12 and small-diameter head portion 14, because a difference in size between ink droplets ejected from the large-diameter head portion and small-diameter head portion is increased, a wider dynamic range can be achieved for a width of gradation controlled by means of dot sizes.

Furthermore, by applying the present invention also to an adhesive for joining the vibration plate and diaphragm, corresponding deformation due to cross-talk and unwanted ejection of the ink material can be further prevented.

Although the present invention has been fully described by way of examples with reference to the accompanying drawings, it is to be noted that various changes and modifications will be apparent to those skill in the art. Therefore, unless otherwise such changes and modifications depart from the scope of the present invention, they should be construed as being included thereto.

What is claimed is:

1. An ink-jet recording head, comprising:

a base having a predetermined elastic modulus and a predetermined thickness;

a plurality of ink chambers for storing ink material, each ink chamber having a nozzle; and a plurality of separate piezoelectric members for pressurizing said ink material to eject the same according to vibration thereof, wherein each piezoelectric member is provided on said base, and wherein cross-talk is reduced by setting a product of the elastic modulus and thickness of said base to $9.0\times10^3$ (kgf/mm) or more.

2. The ink-jet recording head of claim 1, wherein said product of the elastic modulus and thickness of said base is set to $1.0\times10^4$ (kgf/mm) or more.

3. The ink-jet recording head of claim 2, wherein said product of the elastic modulus and thickness of said base is set to $2.1\times10^4$ (kgf/mm) or more.

4. An ink-jet recording head, comprising:

a base;

a plurality of ink chambers for storing ink material, each ink chamber having a nozzle;

a plurality of separate piezoelectric members for pressurizing said ink material to eject the same according to vibration thereof; and an adhesive layer for fixing each said piezoelectric member to said base, said adhesive layer having a predetermined elastic modulus, and a predetermined thickness, wherein cross-talk is reduced by setting a quotient of the elastic modulus of said adhesive layer divided by the thickness of said adhesive layer to $8\times10^3$ (kgf/mm$^3$) or more.

5. The ink-jet recording head of claim 4, wherein said quotient of the elastic modulus of said adhesive layer divided by the thickness of said adhesive layer is $1.0\times10^4$ (kgf/mm$^3$) or more.

6. The ink-jet recording head of claim 4, wherein said quotient of the elastic modulus of said adhesive layer divided by the thickness of said adhesive layer is $2.0\times10^4$ (kgf/mm$^3$) or more.

* * * * *